United States Patent [19]

Noirjean

[11] Patent Number: 4,996,676

[45] Date of Patent: Feb. 26, 1991

[54] MINIATURE ELECTRIC CLOCK

[75] Inventor: Pierre-André Noirjean, Courfaivre, Switzerland

[73] Assignee: ETA S.A. Fabriques d'Ebauches, Grenchen, Switzerland

[21] Appl. No.: 356,362

[22] Filed: May 25, 1989

[30] Foreign Application Priority Data

May 26, 1988 [CH] Switzerland ..... 01997/88

[51] Int. Cl.[5] ..... G04B 23/02; G04C 21/16

[52] U.S. Cl. ..... 368/73; 368/88; 368/250

[58] Field of Search ..... 368/72-74, 368/88, 203, 204, 276, 295, 250, 252

[56] References Cited

U.S. PATENT DOCUMENTS

| | | | |
|---|---|---|---|
| 3,271,945 | 9/1966 | Anderson | 368/295 |
| 3,431,722 | 3/1969 | Haas | 368/295 |
| 3,747,327 | 7/1973 | Uchiyama | 58/23 R |
| 3,979,900 | 9/1976 | Dorflinger et al. | 368/88 |
| 4,000,384 | 12/1976 | Kumazala | 368/250 |
| 4,175,374 | 11/1979 | Yoshizawa | 58/23 R |
| 4,212,155 | 7/1980 | Ogihara et al. | 368/250 |
| 4,263,667 | 4/1981 | Wolber et al. | 368/88 |
| 4,276,634 | 6/1981 | Assmus et al. | 368/204 |
| 4,316,277 | 2/1982 | Endo | 368/88 |
| 4,367,956 | 1/1983 | Windstey | 368/88 |
| 4,426,158 | 1/1984 | Muller et al. | 368/76 |

FOREIGN PATENT DOCUMENTS

| | | |
|---|---|---|
| 2002147 | 2/1979 | United Kingdom . |
| 2064831 | 6/1981 | United Kingdom . |
| 2191610 | 12/1987 | United Kingdom . |

*Primary Examiner*—Vit W. Miska

*Attorney, Agent, or Firm*—Griffin Branigan & Butler

[57] ABSTRACT

The miniature electric clock includes a base plate (28) bearing a motor (11), a going train (21) and time displaying hands (82,100), and a back cover-caseband (10) bearing electrical and electronic elements (7,9) resting on a printed circuit (3) itself fastened to the back cover-caseband. Electrical couplings (15,17) between the motor and the printed circuit are established when the back cover-caseband is united with the base plate. If the clock includes an alarm arrangement other electrical couplings (129,127) are likewise established between the alarm mechanism (66, 88) and the printed circuit when the back cover-caseband is united with the base plate.

6 Claims, 4 Drawing Sheets

MINIATURE ELECTRIC CLOCK

This invention concerns a miniature electric clock including a base plate surmounted by a dial, time displaying hands, a back cover-caseband, a crystal and fastening means for uniting the base plate to the back cover-caseband.

BACKGROUND OF THE INVENTION

A variety of different types of miniature clocks are known, preferably intended to be placed on a table. Should one seek to bring about a very inexpensive timepiece, supplemented if necessary by an alarm function, the material of choice will be of plastic as much for the base plate as for the back cover-caseband. In certain cases even the motion work may be formed of plastic material.

SUMMARY OF THE INVENTION

The originality of this invention resides in the manner of assembling the various components of the clock, these components mainly including a base plate and a back cover-caseband. In order to realize this assembly the miniature clock of the invention is characterized in that the base plate bears a motor and motion work driven by said motor, said motion work driving in turn the time displaying hands, in that the back cover-caseband bears the electrical and electronic elements necessary to control the motor, and in that the electrical connections between the motor and the electrical and electronic elements are established when the back cover-caseband is united with the base plate.

This arrangement implies that prior to assembly with one another the base plate and the back cover-caseband are totally independent and free of any electrical connections whatsoever which would use wires for instance. This enables initially automatic manufacture of each of the individual components, then the assembly of these components one on the other since there is no need to be concerned prior to the assembly with the establishment of electrical connections between the components. Thus one avoids at least one additional work station since the electrical connections are established only when the back cover-caseband is united with the base plate at the time of the single final operation of assembly of the components as considered.

Other advantages of this method of construction and assembly of the electric clock according to the invention will appear with the reading of the description to follow, such description being illustrated by the drawings given by way of example.

DESCRIPTION OF THE PREFERRED EMBODIMENT

Figure 1:
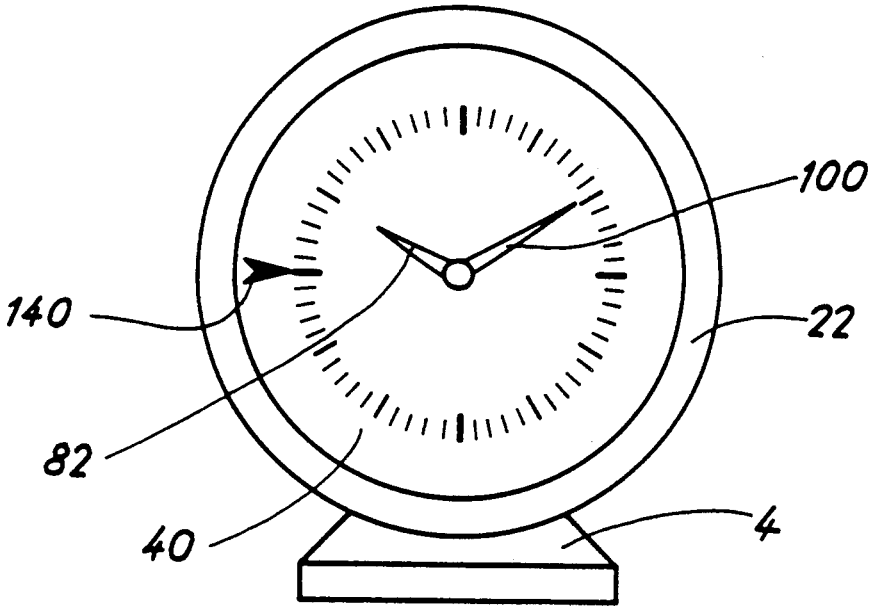
FIG. 1 is a face view of the clock according to the invention.

FIG. 1 is a view of the assembled clock according to the invention. It includes a bezel 22 surrounding a graduated dial 40 over which rotate the hours hand 82 and minutes hand 100. The clock is supported by a pedestal 4. If the clock includes an alarm function, an index 140 indicates the alarm time, this time being selectable at will by manually rotating the bezel 22 as will appear from the explanations to follow hereinafter.

Figure 2:
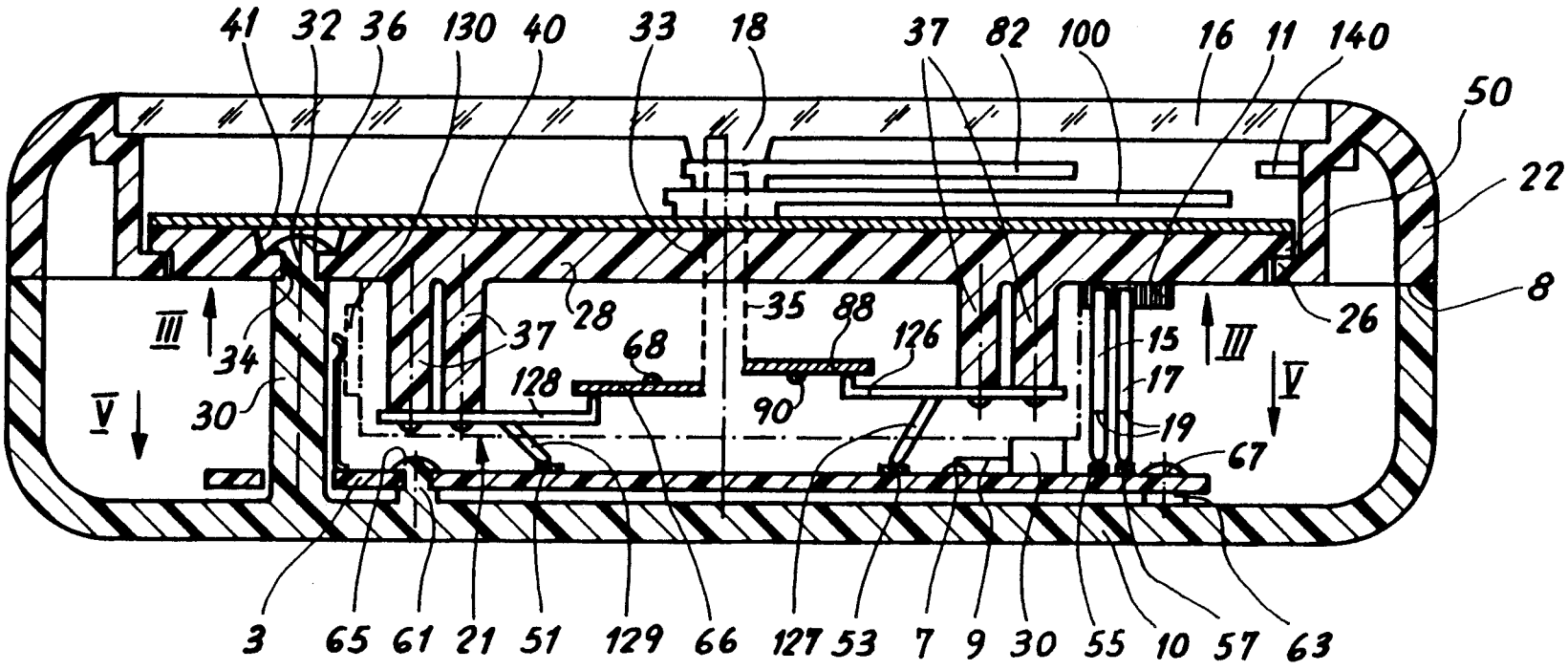
FIG. 2 is a cross-section of the clock shown on FIG. 1.

FIG. 2 is a cross-section of the clock of FIG. 1. This clock includes essentially a back cover-caseband 10, a base plate 28, a bezel 22 and a crystal 16. The base plate 28 is surmounted by a dial 40, itself surmounted by the hands 82 and 100 displaying respectively hours and minutes. Fastening means for uniting the base plate 28 to the back cover-caseband 10 are shown on FIG. 2 in the form of risers 30 integrally formed with the back cover-caseband 10. Each of the risers 30 exhibits at its summit a tenon or stud 32 which passes through a hole 34 of the base plate, the end of said tenon having been flattened in order to form a head 36. If the back cover-caseband is of plastic material, this head may be formed by bringing about melting or fusion of tenon 32. Such head is formed at the bottom of a cup 41 in a manner not to hinder placing of dial 40.

The cross-section of FIG. 2 further shows that the back cover-caseband 10 is completed by a bezel 22. This bezel bears crystal 16 which is fastened thereto for instance by gluing. It will be noted that the bezel exhibits an external edge 8 which is supported on back cover-caseband 10 and an internal edge provided with a flange 26 on which rests the thinned down periphery 50 of the base plate 28. By this arrangement it is understood that the bezel is maintained in its axial position when the back cover-caseband is united with the base plate.

The invention is not however limited to the employment of an independent bezel and this bezel 22 may well form an integral portion of the back cover-caseband 10.

As has been already mentioned, the invention is based on the fact that the base plate includes a motor and motion work driven by the motor, that the back cover-caseband carries the electrical elements necessary to control the motor and that the electrical connections between the motor and the electrical elements are established when the back cover-caseband is united with the base plate. These essential characteristics appear on the cross-section of FIG. 2. The back cover-caseband 10 bears the electrical and electronic elements necessary to drive the motor, in particular a printed circuit 3 provided with contact tracks 51, 53, 55, 57, a quartz 7, an integrated circuit 9 and a battery 130. The base plate 28 supports a motor, the winding 11 of which is shown. To this winding are connected terminals formed of spring blades 15 and 17 each exhibiting a bend 19. These blades are fastened to the baseplate 28. As shown on FIG. 2, blades 15 and 17 are brought into contact with tracks 55 and 57 only when the back cover-caseband is arranged under the base plate 28. The motion work forming part of the base plate 28 is symbolized by rectangle 21 in order not to unduly complicate the drawing. Thus, in the course of mass production, under the base plate 28 there are mounted all the mechanical elements and the motor. In the back cover-caseband 10 there is mounted the printed circuit 3 equipped with all its various components. Thereafter the bezel 22 is placed on the back cover 10 and the base plate 28 is introduced in the bezel 22 until the tenons 32 penetrate into holes 34. At this moment blades 15 and 17 come into contact with tracks 55 and 57 and the heads 36 of tenons 32 may then be formed. It will be understood that this assembly is very simple and lends itself particularly well to robotized machines. The clock may then no longer be disassembled, this being an advantage for a very inexpensive article.

The clock of FIG. 2 furthermore bears an alarm arrangement. To this effect bezel 22 is mounted to be rotatable at the same time on the back cover-caseband 10 and about base plate 28. In this assembly, which includes an arrangement using coincidence of two contact points, the first point is a stud 90 raised on the annular conductive plate 88 fixed to the hour wheel and the second point is a stud 68 raised on an annular conductive plate 66 of the alarm wheel, this latter being manually controlled. These two wheels are coaxially mounted. A feeler 126 rubs against the annular plate 88 and a feeler 128 rubs against the annular plate 66. To feelers 126 and 128 are coupled respectively spring blades 127 and 129 which, when the back cover-caseband is united with the base plate 28, come into contact with tracks 53 and 51 formed on the printed circuit 3. Thus the electrical connection between the alarm switch formed by studs 68 and 90 and forming part of base plate 28 is assured in the same manner as that which has been described hereinabove concerning the motor, i.e. it is assured when the back cover-caseband and the base plate are united to one another.

Figure 3:
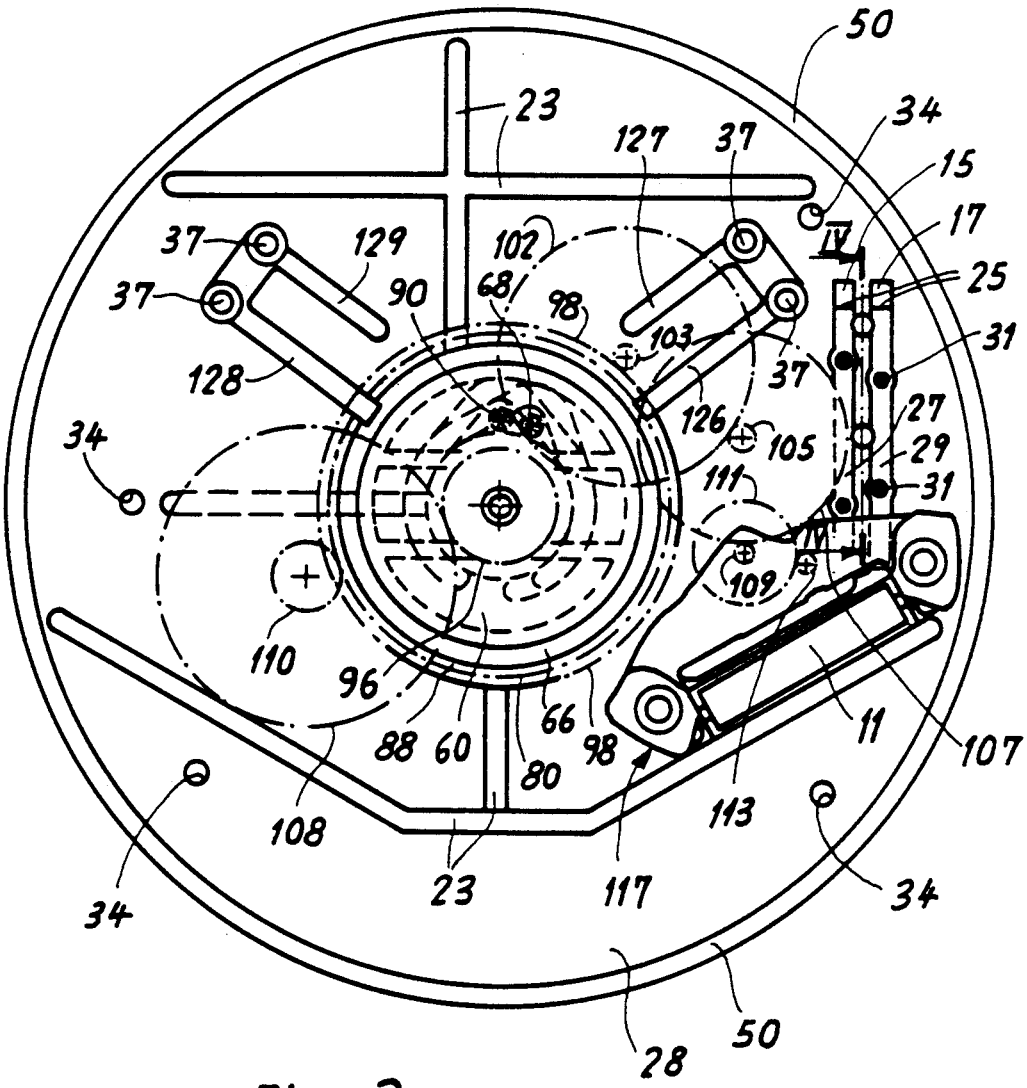
FIG. 3 is a view from below of the base plate forming the clock illustrated in cross-section on FIG. 2 in accordance with arrows III—III, prior to the assembly of the bezel and back cover-caseband.

FIG. 3 is a view from below of base plate 28 assembled with all its elements seen in accordance with arrows III—III of FIG. 2.

Figure 4:
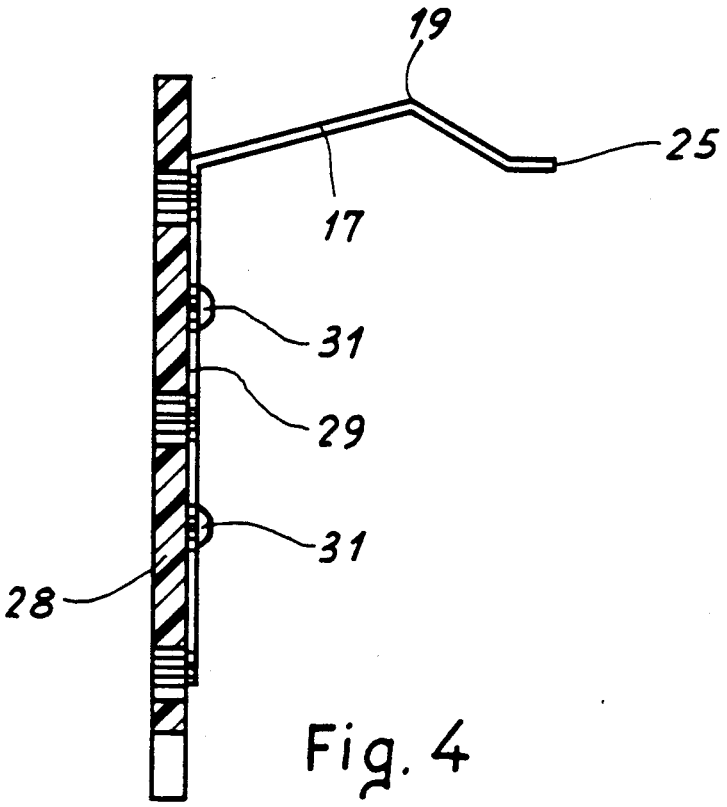
FIG. 4 is a cross-section along line IV—IV of FIG. 3.

Base plate 28 with its thinned down periphery 50 exhibits various reinforcement ribs 23. The base plate is pierced with four holes 34 intended to receive tenons 32 of risers 30 borne by the back cover-caseband 10. The base plate 28 carries a motor 117 the winding 11 of which will be seen. The wires emerging from the winding 11 (not shown) are connected to terminals formed partially of spring blades referenced respectively 15 and 17. The ends 25 of these blades are intended to come into contact with tracks 55 and 57 located on the printed circuit of the back cover-caseband as may readily be seen on FIG. 2. A motor terminal is best seen on FIG. 4 which is a cross-section along line IV—IV of FIG. 3. This terminal is formed by a blade 29 fastened to the base plate 28 by means of heads 31 forming an integral portion of the base plate. This blade is bent in order to form the spring contact 17 which in turn is bent twice in a manner such that the end 25 of the contact is presented perpendicularly to the track of the printed circuit.

The rotor of the motor bears a pinion 113 which drives a first intermediate wheel 111 provided with a pinion 109. Pinion 109 drives a second intermediate wheel 107 provided with a pinion 105. Pinion 105 drives a third intermediate wheel 102 provided with a pinion 103. Pinion 103 drives the minutes wheel 98 which drives via pinion 96 fixed to the minutes wheel the hours wheel 80 via the motion work formed by wheel 108 and pinion 110. Minutes wheel 98 is a cannon wheel which bears the minutes hand 82 and the hours wheel 80 likewise includes a pipe which is inside the pipe of the minutes wheel and which bears the hours hand 100. Within the pipe of the hours wheel is located the axis of the alarm wheel 60, said axis being fixed to a central annular collar 18 borne by the crystal 16 (see FIG. 2) in a manner such that when the bezel is rotated the alarm disc is driven in rotation. As has already been mentioned, to the hours wheel 80 is connected an annular conductive plate 88 on which is raised a stud 90. In the same manner to the alarm wheel 60 is coupled an annular conductive plate 66 on which is raised a stud 68. The dependence of these plates respectively from crystal and its collar 18 and the hours hand 82 is shown on FIG. 2 by the dotted lines 33 and 35.

Feelers 126 and 128 bearing respectively on plates 88 and 66 appear also on FIG. 3 which shows in detail how they are connected to spring blades 127 and 129 respectively. Effectively, the feeler 128 is integral with blade 129. The same is also the case for feeler 126 and blade 127. Feelers and blades together are supported and fastened to pegs 37 integrally formed with base plate 28.

Figure 5:
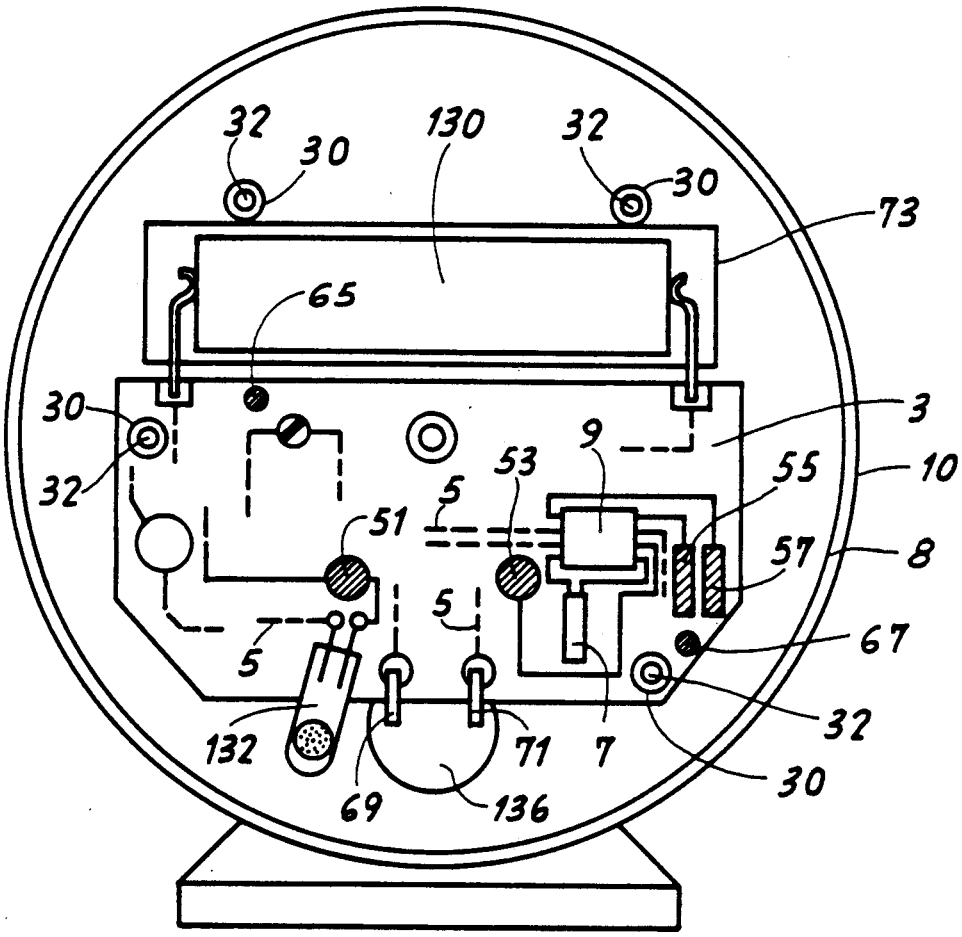
FIG. 5 is a view of the interior of the back cover-caseband of the clock shown in cross-section on FIG. 2 according to arrows V—V prior to the assembly of the bezel and the base plate.

FIG. 5 is a view of the interior of the back cover-caseband 10 shown on FIG. 2 according to arrows V—V of FIG. 2. There will be recognized the printed circuit 3. This latter is fastened to the back cover of the back cover-caseband 10 by means of pegs 61 and 63 and heads 65 and 67. The printed circuit bears various conductors 5 shown in dotted lines and the contact tracks 51, 53, 55 and 57 intended to come into contact with blades 129, 127, 15 and 17 respectively when the base plate is mounted on the back cover-caseband. Circuit 3 bears a quartz 7 and an integrated circuit 9 as well as contact blades 69 and 71 intended to connect the acoustic generator 136 fastened in the back cover-caseband 10. A mercury switch 132 enables placing the generator into or out of function according to the position of the clock. FIG. 5 also shows four risers 30 provided with their tenons 32, these latter being inserted in the holes 34 of base plate 28. In the upper part of back cover 10 is located the battery 130 which is accessible through a hatchway 73 provided in the back cover-caseband.

The parts which form the clock which have just been described require careful and precise manufacture if one wishes to assure the coming together of the contact tracks of the printed circuit with the spring blades which bear on these tracks and this at the moment when the base plate is assembled with the back cover-caseband. This presupposes a know-how and a technical mastery in the domain of plastic materials which the proprietor of this invention is capable of assuring. This experience has been notably acquired in the perfecting of the production techniques of the wrist-watch known under the registered trademark "SWATCH" which likewise belongs to the owner of this invention.

What I claim is:

1. A miniature electric clock including a base plate surmounted by a dial, time displaying hands, a back cover-caseband, a crystal and fastening means for uniting the base plate with the back cover-caseband, the base plate bearing a motor provided with a winding and a going train driven by said motor, said going train driving in turn the time displaying hands, the back cover-caseband having a printed circuit mounted thereon including electrical and electronical elements necessary for controlling the motor and first contact tracks, said winding including terminals partially formed by first spring blades, said first spring blades being brought into contact with said first tracks when the back cover-caseband is united with the base plate.

2. A clock as set forth in claim 1 wherein said fastening means comprises means inseparably joining the back cover-caseband and the base plate when they are united with one another.

3. A clock as set forth in claim 1 further including a bezel surrounding the base plate, said bezel bearing the crystal and exhibiting an outer edge bearing on the back cover-caseband and an inner edge having a flange on which rests the periphery of the base plate to maintain the axial position of said bezel when the back cover-caseband is united with the base plate.

4. A clock as set forth in claim 1 wherein the base plate further bears an alarm arrangement of the type released by the coincidence of two contact points, in which the first contact point is coupled to the hour wheel within the going train and the second contact point is coupled to a manually settable alarm wheel, both wheels being coaxially mounted and each exhibiting an annular conductive plate coupled to the corresponding contact point, each plate including a sensor coupled to a first spring blade the winding associated with the motor including terminals formed by second spring blades, the electrical and electronic elements including among others a sonic generator and a printed circuit provided with contact tracks said first and second spring blades coming into contact with said tracks when the back cover-caseband is united with the base plate.

5. A clock as set forth in claim 4 including a rotatable bezel surrounding the base plate, said bezel having an outer edge bearing on the back cover-caseband and an inner edge provided with a flange on which rests the periphery of the base plate in a manner such as to maintain the axial position of said bezel when the back cover-caseband is united with the base plate, the crystal being secured to the bezel and the alarm wheel bearing a shaft which emerges from the center of the dial and the end of which is fastened to the center of the crystal in a manner to enable manual regulation of the alarm time by rotation of the bezel.

6. A clock as set forth in claim 1 wherein the back cover-caseband includes a hatchway permitting insertion and removal of an energization cell.

* * * * *